United States Patent [19]

Fitch

[11] 4,141,336

[45] Feb. 27, 1979

[54] FIREPLACE STOVE

[76] Inventor: John C. Fitch, Lime Rock Rd., Lakeville, Conn. 06039

[21] Appl. No.: 763,128

[22] Filed: Jan. 27, 1977

[51] Int. Cl.[2] ..... F24B 7/00

[52] U.S. Cl. ..... 126/121; 126/126; 126/136

[58] Field of Search ..... 126/120, 121, 123, 124, 126/126, 136

[56] References Cited

U.S. PATENT DOCUMENTS

| | | | |
|---|---|---|---|
| 1,674,379 | 6/1928 | Taliaferro | 126/126 |
| 2,258,882 | 10/1941 | Craig | 126/121 |
| 2,393,812 | 1/1946 | Robinson | 126/120 |
| 2,703,567 | 3/1955 | Manchester et al. | 126/121 |
| 3,094,980 | 6/1963 | Inabnit | 126/121 |
| 3,533,394 | 10/1970 | Rose et al. | 126/121 |
| 3,601,117 | 8/1971 | Carson | 126/121 |
| 3,654,913 | 4/1972 | Derringer et al. | 126/121 |

*Primary Examiner*—Ronald C. Capossela

*Attorney, Agent, or Firm*—Brumbaugh, Graves, Donohue & Raymond

[57] ABSTRACT

A fireplace stove that is quickly and easily installed in a conventional fireplace with little or no modification of the fireplace or chimney comprises a firebox that is shaped and dimensioned to be at least partly received in a fireplace but with clearance between it and at least some of the walls of the fireplace to facilitate heat transfer by convection. A flue leading from the top of the firebox extends a short distance up into the chimney flue. Oxygen to support combustion in the firebox is supplied by a duct that leads from the chimney flue into the firebox, the inlet opening to the duct being located some distance below the outlet from the stove flue. The space between the stove flue and duct and the chimney flue is closed off so that there is no communication between the fireplace, and thus the living space, and the chimney flue, thereby eliminating loss of heat from the living space by natural draft up the chimney flue and providing for delivery of heat by radiation, convection and conduction from the stove to the room efficiently.

14 Claims, 5 Drawing Figures

FIREPLACE STOVE

BACKGROUND OF THE INVENTION

There are several tens of millions of residences in the United States (and many scores of millions of residences throughout the world) that have fireplaces for auxiliary heating and for enjoyment. Unfortunately, a conventional fireplace is grossly inefficient in that it is a source of a very large heat loss by way of natural draft up the chimney flue. About the only solutions proposed and adopted to any extent to improve efficiency are special fireplace installations that provide for controlled convection of heat recovered from the walls of the fireplace and, in some cases, the chimney to the living space by way of ducts and chambers built around the fireplace and chimney to receive heat and conduct it to the living space. Such installations are somewhat successful in increasing the amount of heat delivered to the living space, but do not solve the basic problem of eliminating heat loss due to chimney draft. It has also been proposed that some heat loss through chimney draft can be eliminated by providing some of the air that supports draft in the chimney from outside the living space, but that solution is only partially effective inasmuch as it is necessary for some air from the living space to go up the chimney in an open fireplace in order to prevent smoke from intruding into the living space. Accordingly, the suggestion of providing outside air to support combustion in the fireplace and chimney draft probably has as many disadvantages as advantages.

Within the last three or four years, the costs of residential heating have multiplied, and supplies of fuel oil and natural gas, the predominant sources of energy for generating heat for residential heating, have become increasingly uncertain. The tremendous increase in cost and the uncertainty of supply have created a great demand for efficient and economical auxiliary sources of heat. Though many persons are relying more on their fireplaces as such a source, the low efficiency of the conventional fireplace makes it a far from adequate solution to the problem.

SUMMARY OF THE INVENTION

The main purpose of the present invention is to improve the efficiency of a conventional fireplace at relatively low cost. The invention is a stove that is quickly and easily installed in a conventional fireplace with little or no modification of the fireplace or chimney. The stove can be mass produced at low cost, is capable of burning a variety of fuels, including trash, and eliminates the principal source of heat loss in conventional fireplaces, chimney draft.

In particular, the stove comprises a firebox that is shaped and dimensioned to fit partly or entirely into a conventional fireplace with clearance between it and at least some of the walls of the fireplace to facilitate heat transfer by convection around the firebox. At least one flue extends from the top of the firebox a short distance up into the lower end of the chimney flue for conducting smoke from the firebox into the chemney flue. One or more ducts lead from the chimney flue to the firebox and conduct oxygen from the chimney flue into the firebox to support combustion of fuel. The space left between the stove flue and the duct and the chimney is closed to prevent communication between the fireplace and the chimney flue, and especially to prevent chimney draft in the form of warm air from the living space.

It is desirable, though not essential, that the duct of the stove communicate with the firebox at a location near the bottom so that oxygen to support combustion enters the stove near the fuel. Preferably, a second outlet from the duct (or another duct) opens into the firebox at a location between the top and bottom, oxygen from the second outlet (or second duct) entering above the fire and supporting combustion of gaseous and particulate combustibles evolving from the fire. Although the place (or places) where oxygen enters the firebox is not a critical aspect of the invention, it is a factor in the design parameters that affects stove efficiency. As is explained in greater detail below, it is advantageous to be able to vary the amount of oxygen delivered by the duct to the firebox by providing an adjustable damper in the duct. A small fan may be installed in the duct to enhance the flow of oxygen into the firebox, but this is strictly an optional feature.

Heat from the fire can be more effectively distributed to the front, top and side walls of the firebox by installing a baffle above the fire area and across the back part of the firebox. The baffle directs the hot gases of combustion toward the front and top of the firebox and assists in enhancing the transfer of heat to the firebox and reducing losses to the flue. Heat transfer from the gases in the firebox to the firebox walls can be further enhanced by retarding the outflow of hot gases by extending the flue a short distance, say 1 inch to 3 inches, down into the firebox.

The baffle above the fire area can be made hollow such that it is, in effect, a duct which can be connected to the secondary outlet from the main duct of the stove and can be provided with an outlet in generally the center of the firebox, the outlet from the hollow baffle preferably being formed to discharge oxygen-containing gas downward to support burning of combustibles into the smoke from the fire.

The front of the firebox has at least one door for physical access to introduce fuel and for visual access to permit viewing of the fire. Except for instances in which the user wants to enjoy watching the fire, the stove is normally operated with the door closed in order to eliminate loss of warm air from the living space through chimney draft. On the other hand, the stove, even when operated with the door open, reduces loss of warm air from the living space because of the reduced size of the flue, as compared to the chimney flue, the contribution of outside air to the chimney draft and the smaller opening through the stove door.

In the most efficient mode of operation of the stove, i.e., with the door closed, the smoke and fumes from the fire in the firebox leave the firebox through the stove flue and rise up the chimney flue. Oxygen to support combustion in the firebox is contained in the atmosphere of the fireplace flue and is drawn down the inlet duct as a component of ambient gases in the chimney flue. Such ambient gases enter at the bottom of the firebox and support burning of fuel from below and also enter part way up the firebox to support combustion of combustibles that are driven off as the fuel burns. In addition to contributing to the heat generated in the stove, the burning of such combustibles makes the smoke cleaner and reduces the need for cleaning the chimney flue and the hazards of a chimney fire.

The fire in the firebox heats the walls of the firebox and the hot walls of the firebox not only radiate heat to the living space, but heat the air around the firebox within the fireplace. Inasmuch as space is left between the firebox and the fireplace walls, the heated air is conducted by convection out of the fireplace into the room. Because the chimney flue is closed off from the fireplace, there is no loss of hot air from the living space to the chimney. The elimination of these heat losses to the chimney and the improvement of heat transfer to the living space combine to provide a vast improvement in efficiency as compared to a conventional fireplace. Additional improvements in effectiveness are derived from the ability to control the rate of combustion of the fuel in the stove. The ability to burn a variety of fuels that would not ordinarily be burned in a fireplace and that may be readily available at low cost, is yet another advantage. For example, trash and garbage can be burned in the stove, preferably by installing a temporary grating somewhat above the bottom of the firebox.

For a better understanding of the invention, reference may be made to the following description of exemplary embodiments, considered in conjunction with the figures of the accompanying drawings.

DESCRIPTION OF THE EMBODIMENT

Figure 1:
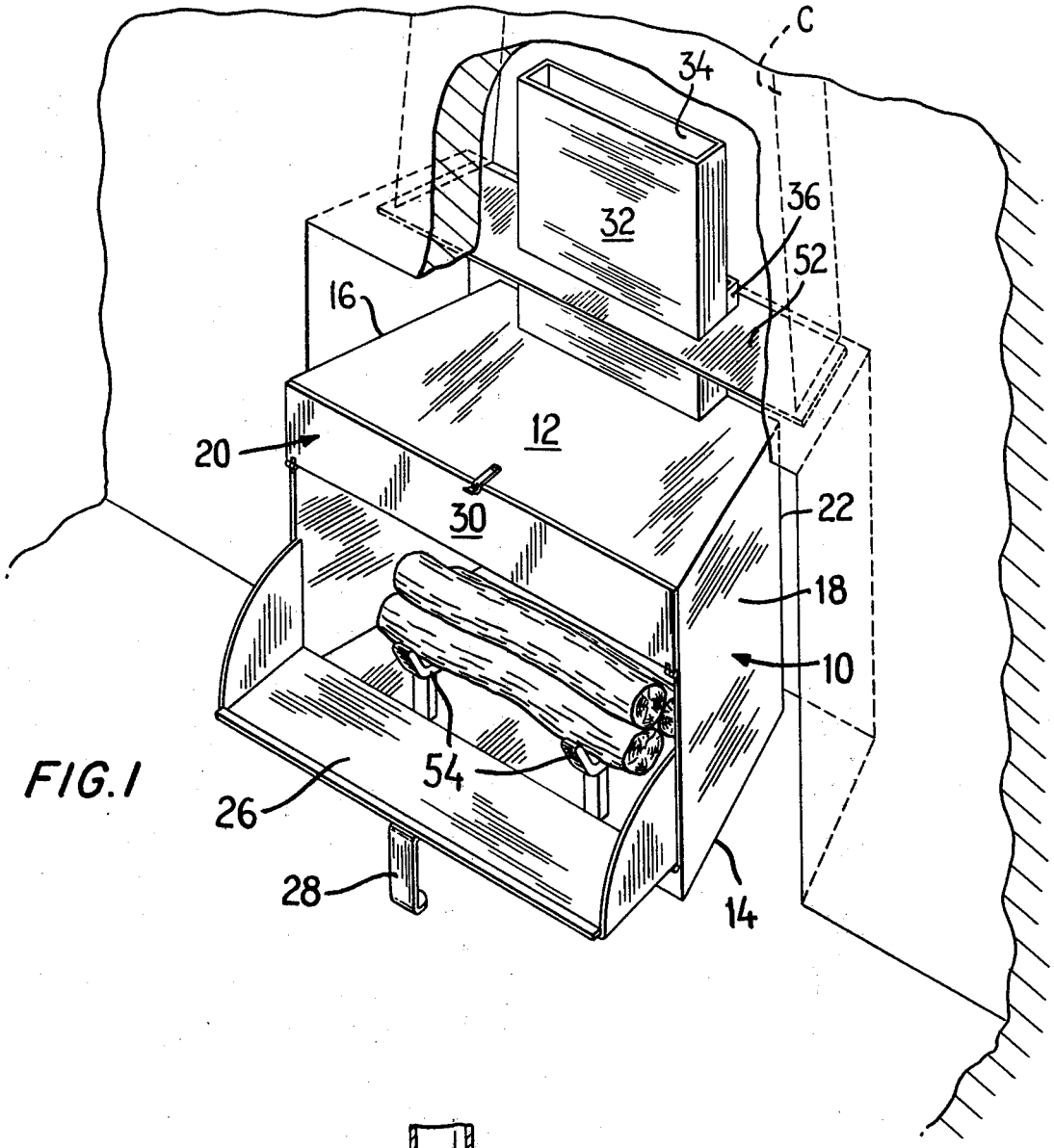
FIG. 1 is a pictorial view of one form of stove, according to the invention, taken from in front, above and one side.

The firebox 10, as its name implies, is a box or receptacle having top and bottom walls 12 and 14, side walls 16 and 18, and front and back walls 20 and 22. It is shaped and dimensioned to be received within the majority of conventional fireplaces, it being understood, of course, that the stove can be made in a range of shapes and sizes to fit into fireplaces of various shapes and sizes. Cast iron is a preferred material, but the firebox can also be made of steel plate. It is preferably supported on legs 24, and at least some, and preferably all, walls are spaced from the walls of the fireplace. (The fireplace is shown in phantom lines designated "F" in FIGS. 2 and 3.) The front wall 20 is constituted, for the most part, by a lower door 26 that is hinged near the bottom of the firebox so that it opens out and down into the position shown in FIG. 1. A door handle 28 can be attached at one end by a hinge to the door so that it can be swung out to rest on the floor and support the door 26 in a substantially horizontal orientation, in which case it resembles a fireplace hearth. The front wall 20 also includes an upper door 30 that is hinged along its top and can be swung up to lie flush with the upper part of the front wall and secured in the open position (see FIG. 1). The upper door is optional in the stove shown in the drawings; a single large door can also be used (see FIG. 5).

A smoke outlet flue 32 extends up from the back center part of the top wall 12 and a short distance up into the chimney (shown in phantom lines labelled "C" in FIG. 2) and conducts smoke and fumes from the firebox into the chimney flue from the outlet opening 34 at its upper end. Many chimney flues have a smoke shelf of the general form illustrated in FIG. 2 and designated "S", and it is preferable that the outlet opening 34 of the stove flue 32 be located above the smoke shelf "S".

A duct 36 that extends coextensively with the lower portion of the flue 32 and down the back wall 22 of the firebox 10 conducts oxygen-containing ambient gases from the chimney flue to and out a primary outlet opening 38 near the bottom of the firebox and a secondary outlet opening 40 part way up the back wall of the firebox. The primary opening 38 is preferably formed by a downwardly and forwardly inclined baffle 42 that assists in discharging the oxygen-containing gas with downward and forward components of velocity so that the gas tends to be distributed across the bottom of the firebox. The inlet opening 44 at the upper end of the duct 36 is located some distance below the outlet opening 34 from the stove flue 32 in order to minimize a short circuit flow of smoke and fumes from the flue to the duct. Gas flow within the chimney flue tends to channel fresh air to the lower part of the flue (because cold air flows down), and thus more oxygen is likely to be present some distance below the outlet from the stove flue and at and below the smoke shelf "S" than at the locations higher up in the chimney flue.

Figure 2:
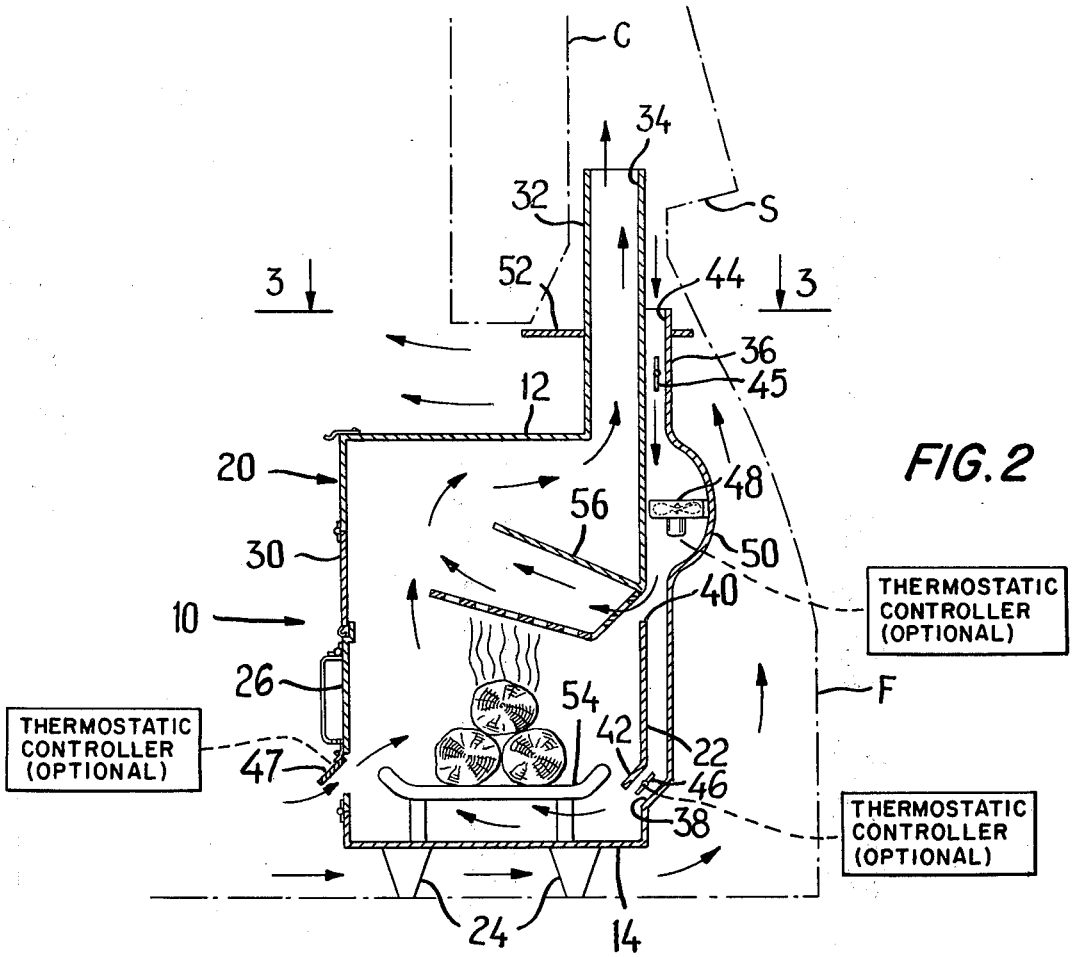
FIG. 2 is a side, cross-sectional view of the stove shown in FIG. 1.

The quantity of oxygen delivered to the firebox to support combustion of the fuel is controlled by adjustable dampers 45, 46 and 47. The proportions of oxygen delivered through the primary and secondary outlets 38 and 40 are established by the relative sizes of those outlets in addition to the effect of dampers 45 and 46 in FIG. 2. The damper 45 controls the total volume of air entering the firebox coincidentally at the secondary outlet opening 40 and at the primary outlet opening 38 when damper 46 is open. The damper 45 also controls the amount of air entering at secondary outlet opening 40, when damper 46 in FIG. 2 is closed. Dependent upon the state of the fire and the rate of combustion desired, damper 46 may be closed and damper 45 open, whereupon all the oxygen is delivered through the secondary outlet opening 40. A small, adjustable port 47 is provided, preferably near the bottom of the front door, to increase the supply of oxygen to the fire, such as when it is started or when it shows signs of dying out. Although not essential to good operation of the stove, it may be desirable, as an option, to provide a booster fan 48, the fan being located in a small housing 50 attached to the back wall of the duct 36.

The top of the fireplace is closed off from the chimney by a plate 52 that is suitably attached, preferably in an adjustable manner, to the flue 32 and duct 36. For simple installation in fireplaces of various sizes, one of a variety of constructions that make the plate 52 adjustable in size and vertical position can be used to advantage. The plate 52 blocks the loss of hot air from the living space to the chimney and the admission of cold ambient air drafts from the chimney to the living space, both when the stove is in use and when it is not in use.

As shown in FIG. 2 of the drawings, fuel for the fire is placed in the bottom of the firebox, preferably on a grating 54. Circulation of oxygen-containing gas to the firebox to support combustion of the fuel and convection from the firebox of smoke and fumes is provided by the natural draft of hot gases rising through the chimney flue. That draft draws oxygen-containing gas through the duct for admission to the firebox through the primary and secondary openings 38 and 40 by a syphoning action.

Good distribution of heat in the stove is enhanced by providing a baffle 56 between the fire in the bottom of the firebox and the outlet from the firebox to the flue 32. The baffle, which extends from the back wall in an upwardly inclined direction and entirely across the firebox between the side walls 16 and 18, deflects the hot gases from the fire toward the front and top of the firebox so that more heat is transferred to the front and top.

Figure 4:
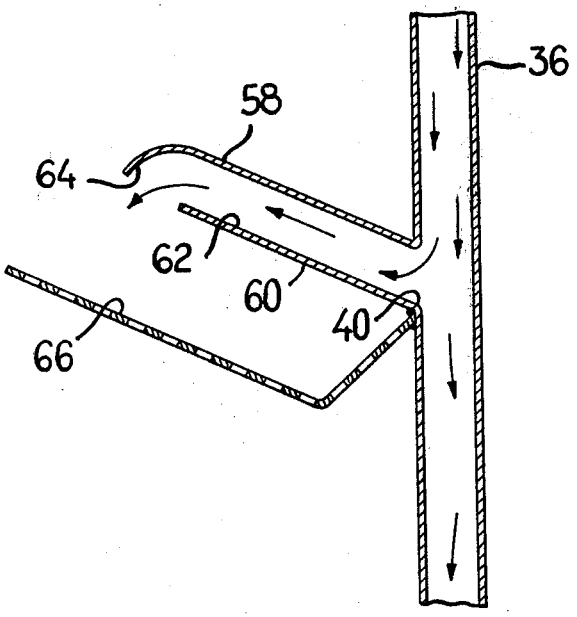
FIG. 4 is a fragmentary detail view in cross-section showing an optional hollow baffle and a trash grate for use in the stove of FIGS. 1 to 3.
Figure 3:
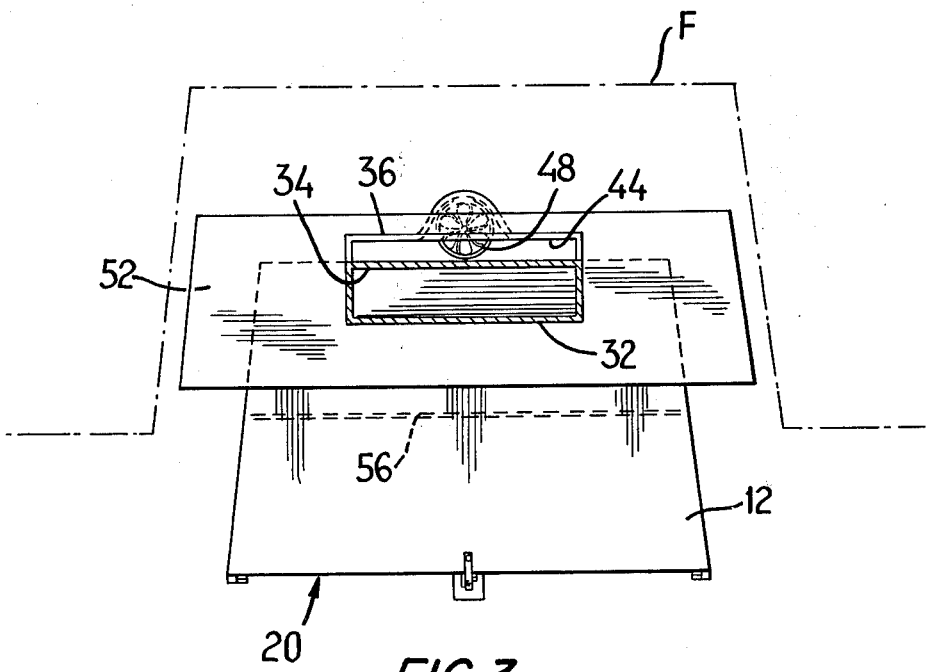
FIG. 3 is a top view of the stove shown in FIG. 1.

A modification of the baffle that can be used instead of the plain baffle 56 of FIGS. 1 to 3 is shown in FIG. 4. The modification involves making the baffle hollow in whole or in part to define between plates 58 and 60 a passage 62 that communicates with the secondary opening 40 of the duct 36. Part of the oxygen-containing gas flowing down the duct 36 flows through the passage 62 and is discharged through an outlet opening 64 which, preferably, faces generally down toward the rising smoke and fumes from the fire.

For burning certain types of combustible materials in the stove, such as trash and garbage, a trash grate 66 can be temporarily installed in the firebox. Any of a variety of ways of mounting the trash grate can be employed, and it is unnecessary to go into details here.

The most efficient operation of the stove requires that the doors 26 and 30 and the port 47 (described below) be kept closed. This eliminates any path for flow of heated air in the living space into and up the chimney. The natural draft of rising hot gases up the chimney flue induces flow through the duct 36 of oxygen-containing gas to support combustion in the firebox. The rate of burning of the fuel in the firebox is controlled by adjusting the position of the dampers 45 and 46, and either leaving the optional fan 48 (if provided) off or turning it on. One or more of the dampers 45 and 46, an auxiliary port 47 at the front of the firebox and/or the optional fan 48, may be activated by heat sensitive thermostats and may be, thereby, the basic means of controlling the rate of combustion, in place of or in conjunction with the manual operation of these devices. In case the port at the front of the firebox is the sole or a supplementary thermostatically controlled means of controlling the rate of combustion, said port 47 will ideally be closed when the stove is operating optimally in order to eliminate or virtually eliminate the use of air from the living space to support combustion, for reasons previously explained. Opening the port 47 to increase the rate of combustion, such as at start-up, will also, by increasing chimney draft, stimulate the syphoning action by which oxygen-containing gases are drawn down the duct into the firebox by chimney draft. The slower the rate of entry of oxygen in the firebox, the more slowly the fuel will burn, and the slower is the generation of heat by the stove. Thus, the heat output of the stove can be regulated by the user in accordance with the burning characteristics of the fuel and the need or desire for distribution of heat from the stove to the living space. Distribution of heat to the living space is by a combination of radiation from the hot surfaces of the stove and convection of air in the space around the stove as air around the stove is heated and rises to the top of the fireplace and, because the chimney is closed by the plate 52, the hot air has nowhere to go but into the living space. Cool air near the floor of the living space enters under the stove and replaces the hot air discharged from the top of the fireplace.

It should not normally be necessary to open the doors of the stove to provide additional air to support combustion of the fuel, but the doors can be opened for that purpose. For example, when a fire is being started in the stove, opening the doors to increase the supply of oxygen to the fire and the draft in the chimney may be helpful or necessary to get the fire started quickly and easily. Also, the user may derive pleasure from time to time in opening the doors to view the fire (see FIG. 1).

A number of modifications and variations in the stove are within the spirit and scope of the invention. Among them (and the following is by no means a complete list) is varying the arrangement of the flue and duct, such as by placing them side by side (instead of front to back as shown). Another is relocating the outlet or outlets from the duct or ducts.

Figure 5:
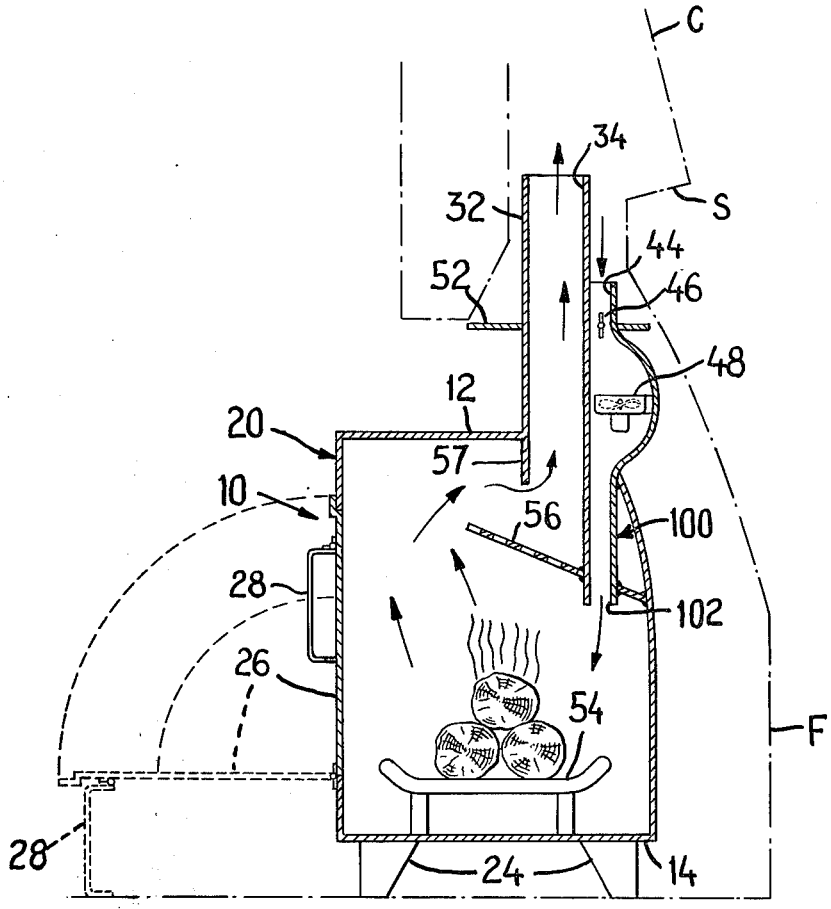
FIG. 5 is a side cross-sectional view of another embodiment of the invention.

FIG. 5 shows one of the modifications alluded to above — a different duct arrangement. The stove shown in FIG. 5 is the same as the one shown in FIGS. 1 to 3, except that the oxygen supply duct 100 extends only to about the mid-height of the firebox and opens just below the baffle 56. The opening 102 from the duct 100 faces the bottom of the firebox so that oxygen-containing gases syphoned through the firebox are directed down toward the fire but tend also to be distributed to the zone above the fire to support combustion of unburned combustible gases evolved from the fuel. FIG. 5 also shows a lower extension 57 on the flue 32 that extends about 1 inch to 3 inches down into the firebox and impedes convection of hot gases from the firebox, thereby to enhance heat transfer to the firebox walls.

I claim:

1. A stove for a fireplace having a chimney flue which includes a lower end opening to the fireplace comprising top, bottom, back and side walls and a front door defining a firebox shaped and dimensioned to be received at least partly within the fireplace, at least one stove flue leading from the top wall of the firebox and adapted to extend up into the lower end of a chimney flue to conduct smoke from the firebox to the chimney flue from an outlet opening at the upper end of the stove flue, at least one duct leading to the firebox from the chimney flue and having at least one outlet opening in the firebox to conduct a gas that includes oxygen from the chimney flue into the firebox to support combustion of combustible material in the firebox, the duct having an inlet opening adapted to be located within the chimney flue at a location below the outlet opening from the stove flue to the chimney flue, and closure means at the lower end of the chimney flue for substantially preventing air flow between the fireplace and the chimney flue.

2. A stove according to claim 1 wherein there is an outlet opening in the duct located in proximity to the bottom of the firebox.

3. A stove according to claim 1 wherein there is an outlet opening in the duct at a location intermediate the top and bottom of the firebox so that oxygen is delivered above a fire in the firebox to support combustion of combustible gases evolved from a fuel in the firebox.

4. A stove according to claim 1 wherein the duct includes a first outlet opening located in proximity to the bottom of the firebox and a second outlet opening located at a position intermediate the top and bottom of the firebox and adapted to deliver oxygen-containing gas above a fire in the firebox to support combustion of combustible gases evolved from a fuel in the firebox.

5. A stove according to claim 1 and further comprising a baffle extending forwardly from the back wall of the firebox at a location intermediate the top and bottom walls for deflecting hot gases from a fire in the firebox generally forwardly.

6. A stove according to claim 5 wherein the baffle is hollow and is connected to the duct to receive oxygen therefrom and has an outlet opening for discharging oxygen from the duct into generally the middle of the firebox.

7. A stove according to claim 1 and further comprising means in the duct for controlling the quantity of gas conducted from the chimney flue to the firebox.

8. A stove according to claim 7 wherein said controlling means includes at least one adjustable damper.

9. A stove according to claim 8 and further comprising means for thermostatically controlling adjustment of said damper.

10. A stove according to claim 7 wherein said controlling means includes a blower.

11. A stove according to claim 9 and further comprising means for thermostatically controlling said blower.

12. A stove according to claim 1 wherein the firebox includes at least one door in the front wall thereof for physical access to the firebox for charging fuel into it and for visual access to a fire in the firebox.

13. A stove according to claim 1 and further comprising an auxiliary port located in a wall of the firebox and adapted to be opened selectively to conduct air into the firebox.

14. A stove according to claim 13 and further comprising means for thermostatically controlling the auxiliary port.

* * * * *